US009707565B2

(12) United States Patent
Lyne, II

(10) Patent No.: US 9,707,565 B2
(45) Date of Patent: Jul. 18, 2017

(54) SCREEN ASSEMBLY FOR SHREDDING MACHINE

(71) Applicant: Lyman Burdette Lyne, II, Hughesville, MO (US)

(72) Inventor: Lyman Burdette Lyne, II, Hughesville, MO (US)

( * ) Notice: Subject to any disclaimer, the term of this patent is extended or adjusted under 35 U.S.C. 154(b) by 0 days.

(21) Appl. No.: 14/680,322

(22) Filed: Apr. 7, 2015

(65) Prior Publication Data

US 2015/0290653 A1 Oct. 15, 2015

Related U.S. Application Data

(60) Provisional application No. 61/977,150, filed on Apr. 9, 2014.

(51) Int. Cl.

| | |
|---|---|
| ***B02C 18/22*** | (2006.01) |
| ***B02C 18/14*** | (2006.01) |
| ***B02C 18/16*** | (2006.01) |
| ***B02C 23/16*** | (2006.01) |

(52) U.S. Cl.

CPC ..... *B02C 18/2216* (2013.01); *B02C 18/148* (2013.01); *B02C 2018/164* (2013.01); *B02C 2023/165* (2013.01)

(58) Field of Classification Search

CPC ..... B02C 18/2216; B02C 18/148; B02C 2018/164; B02C 2023/165

USPC ..... 241/73, 88.4

See application file for complete search history.

(56) References Cited

U.S. PATENT DOCUMENTS

| | | | | |
|---|---|---|---|---|
| 763,639 | A | 6/1904 | Schoellhorn | |
| 1,185,620 | A | 6/1916 | Blum | |
| 1,286,831 | A | 12/1918 | Sturtevant | |
| 1,420,355 | A | 6/1922 | Williams | |
| RE17,334 | E | 6/1929 | Liggett | |
| 2,054,507 | A | 9/1936 | Mankoff | |
| 3,554,454 | A | 1/1971 | Gruendler | |
| 3,678,938 | A * | 7/1972 | De Coene | A01F 12/442 460/73 |
| 3,716,144 | A * | 2/1973 | Bartlow | B01D 29/03 210/499 |
| 3,722,805 | A * | 3/1973 | Strom | B02C 13/284 241/189.1 |
| 3,788,566 | A | 1/1974 | Morris, Jr. | |
| 3,805,955 | A * | 4/1974 | Bixby | B07B 1/12 209/395 |
| RE28,368 | E | 3/1975 | Bonarrigo, Jr. | |
| 4,706,898 | A | 11/1987 | Schonfeld | |
| 4,830,291 | A | 5/1989 | Williams | |
| 5,018,674 | A | 5/1991 | Williams | |
| 5,381,971 | A | 1/1995 | Rehmer | |
| 5,381,972 | A | 1/1995 | Chon | |

(Continued)

*Primary Examiner* — Moshe Wilensky
*Assistant Examiner* — Joseph Finan, Jr.
(74) *Attorney, Agent, or Firm* — CreatiVenture Law, LLC; Dennis JM Donahue, III

(57) ABSTRACT

A screen for a shredder machine has a shape that avoids clogging of the materials being processed through the shredder. The screen has a pair of mounting plates that are connected to the shredder with one mounting plate attached toward the top of the rotor and the other mounting plate attached toward the bottom of the rotor and extending the entire length of the rotor. Arcuate ribs are attached to and extend between the mounting plates, and a grid is attached to the ribs.

20 Claims, 5 Drawing Sheets

(56) References Cited

U.S. PATENT DOCUMENTS

| | | | | | |
|---|---|---|---|---|---|
| 5,462,238 | A * | 10/1995 | Smith | B02C 18/145 | 241/243 |
| 5,526,988 | A | 6/1996 | Rine | | |
| 5,613,907 | A * | 3/1997 | Harden | A01F 12/26 | 460/109 |
| 5,628,467 | A | 5/1997 | Graveman | | |
| 5,911,372 | A * | 6/1999 | Williams, Jr. | B02C 18/146 | 241/239 |
| 6,305,623 | B1 | 10/2001 | Sotsky | | |
| 7,434,756 | B2 | 10/2008 | Sotsky | | |
| 8,021,548 | B2 * | 9/2011 | Gross | B01D 29/012 | 210/244 |
| 8,360,349 | B1 | 1/2013 | Sotsky | | |
| 2002/0050538 | A1 | 5/2002 | Fabio | | |
| 2013/0240652 | A1 * | 9/2013 | Gardner | B07B 1/185 | 241/89.1 |
| 2015/0231643 | A1 * | 8/2015 | DeBoef | B02C 19/20 | 241/88.4 |

* cited by examiner

Alternate Fish Scale Design

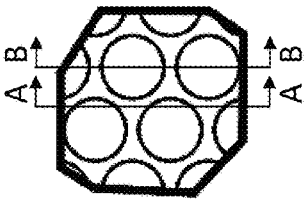
FIG. 5
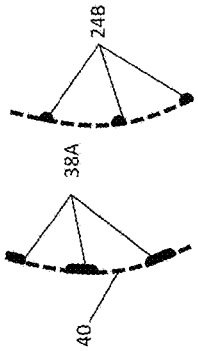
FIG. 5A
FIG. 5B
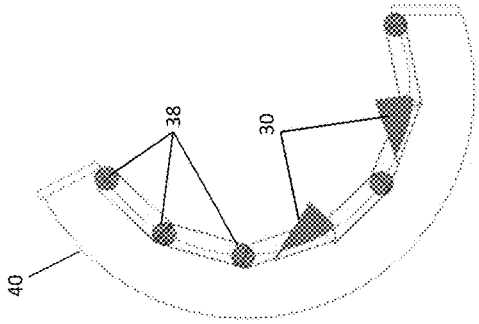
FIG. 6B
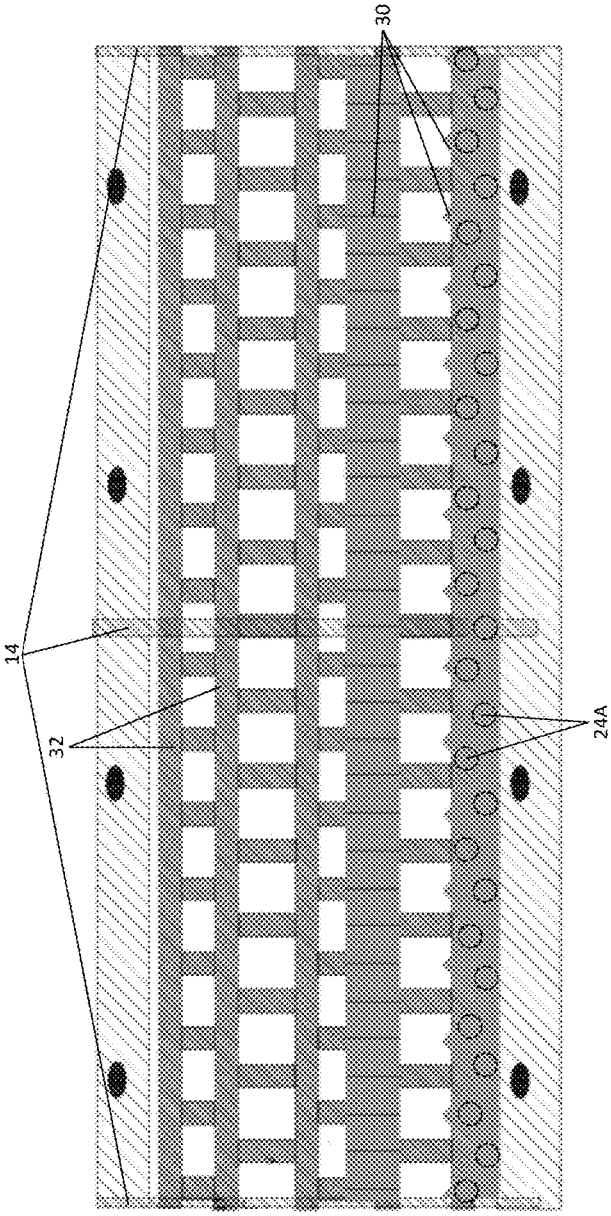
FIG. 6A

SCREEN ASSEMBLY FOR SHREDDING MACHINE

CROSS-REFERENCE TO RELATED APPLICATIONS

This application claims priority from U.S. Provisional Patent Application Ser. No. 61/977,150 filed on Apr. 9, 2014 which is hereby incorporated by reference.

STATEMENT REGARDING FEDERALLY SPONSORED RESEARCH

Not Applicable.

APPENDIX

Not Applicable.

BACKGROUND OF THE INVENTION

Field of the Invention

The present invention relates to shredder machines and similar crushing, pulverizing and grinding machines, and more particularly to an improved screen used for them.

Related Art

Shredder machines which use screens in close proximity to rotors have been used to break down post-consumer materials and other materials, particularly including plastic materials, such as polyethylene (PE) and polypropylene (PP). The screens are generally curved to maintain a close proximity to the cutters or blades of the spinning rotors and are generally smooth or flat on the side facing the rotor/cutter assembly. It is a known problem for the post-consumer materials to get caught in the screen and to clog the screen. This clogged screen can result in increased friction which generates additional heat and causes additional wear on the cutters and typically requires the shredder machine to be shut down so that the clogged materials can be cleared from the screen. Additionally, clogged screens can reduce the throughput of the machine. Previous screen designs have sought to solve the problem of clogged materials by using grooves on the inner side of the screen facing the rotor assembly that are aligned with the cutters on the rotor such as described in U.S. Pat. No. 6,305,623. When the rotor's cutters pass through the grooves, they further cut and force out any material that is caught up in the screen.

Although this previous screen design allows the rotor to clean the screen as the cutters pass through the grooves, the screen is not designed to help prevent the material from getting caught by the screen in the first instance. To use the cutters for cleaning out the materials that get caught in the screen, additional force and corresponding power is required for the rotor assembly and causes reduced throughput. This previous design also results in high stress zones at the grooves which prematurely wear down the cutters and the screen which then require servicing. The screens for most shredder machines are fabricated from metal plates in which the holes are cut or punched through the plates, and the screen is supported by a series of ribs. When material is caught in the screens, the screens can deflect and cause premature dulling of the cutters and wear on the screen, sometimes leading to the failure of the screen. It would be better to create screen designs that avoid materials becoming caught in the first instance so that additional power is not necessary and premature dulling of the cutters is prevented and the wear of screen is reduced.

Another problem with previous designs which permit materials to clog screens is the possibility of overheated gearboxes along with the additional power that is used to force the rotor to continue grinding the material. To avoid the overheating of the gearboxes, the throughput of shredders is limited because of the current screen designs which permit materials to get caught. Even without overheating the gearboxes, the increased heat of these prior art systems increases the frequency in which the gearbox oil must be changed as compared with a screen that is much less prone to getting clogged.

SUMMARY OF INVENTION

The present invention is an improved screen that is installed on a shredding machine in close proximity to the shredder's rotor and which has a shape that avoids clogging of the materials being processed through the shredder. The screen has a pair of mounting plates that are connected to the shredder with one mounting plate attached toward the top of the rotor and the other mounting plate attached toward the bottom of the rotor and extending the entire length of the rotor. Arcuate ribs are attached to and extend between the mounting plates, and a grid is attached to the ribs.

BRIEF DESCRIPTION OF THE DRAWINGS

The present invention will become more fully understood from the detailed description and the accompanying drawings.

FIG. 5 is a partial view of a screen with an alternative grid design.

FIGS. 5A and 5B are cross-sectional views of the screen shown in FIG. 5.

FIGS. 6A and 6B are front and end views, respectively, of a screen according to yet another embodiment of the invention.

DETAILED DESCRIPTION OF THE PREFERRED EMBODIMENTS

Figure 1A:
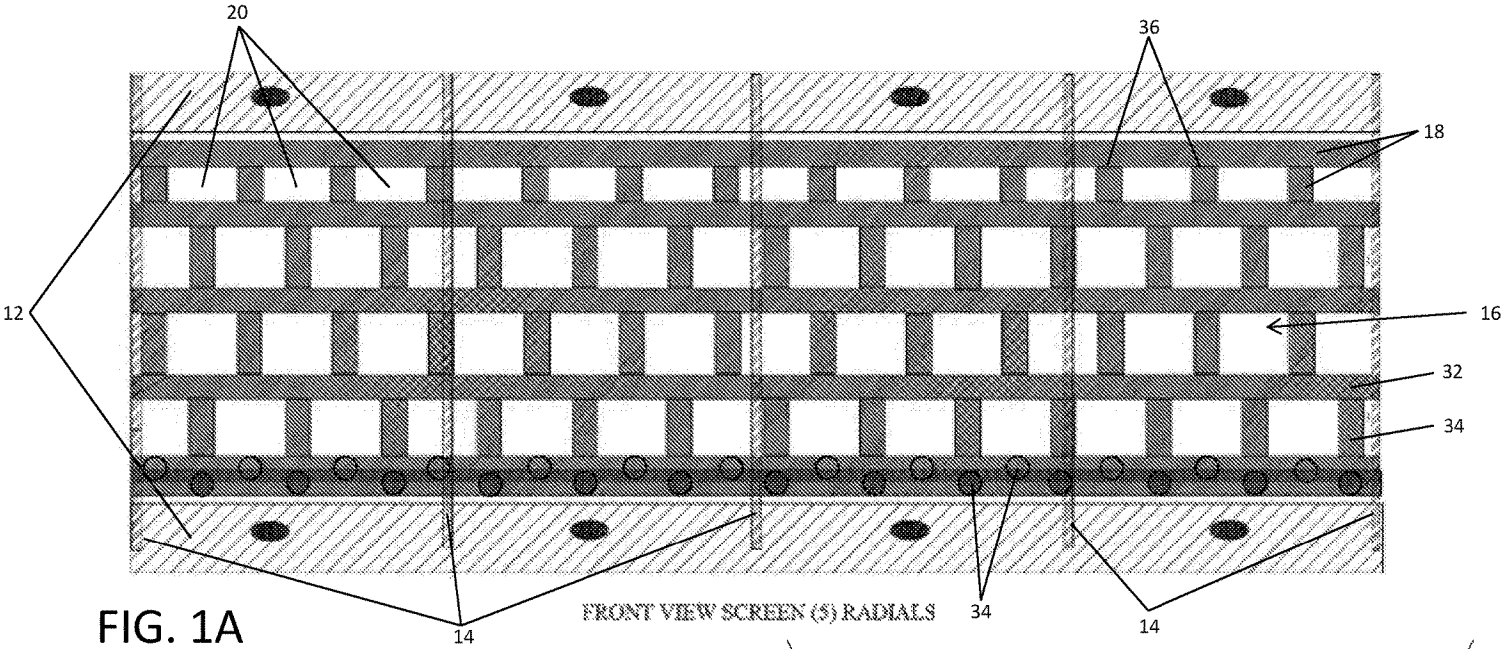
FIGS. 1A and 1B are front and end views, respectively, of a screen according to an embodiment of the invention.

Generally, the invention is an improved screen 100 that is installed on a shredding machine 110 in close proximity to the shredder's rotor 120 and which has a shape that avoids clogging of the materials being processed through the shredder. The screen has a pair of mounting plates 12 that are connected to the shredder with one mounting plate attached toward the top of the rotor and the other mounting plate attached toward the bottom of the rotor and extending the entire length of the rotor. Arcuate ribs 14 are attached to and extend between the mounting plates, and a grid 16 is attached to the ribs.

The grid 14 has lateral 32 and longitudinal 34 structural elements which surround and form the apertures 20 through which the material passes when it is ground down between the rotor 120 and the structural elements 18. Accordingly, the grid serves as a sieve with the apertures defining the sieve size. The lateral structural elements 32 extend between the ribs and are spaced apart from each other from the top mounting plate to the bottom mounting plate. The longitudinal structural elements 34 extend between and are connected to the lateral structural elements. The structural elements intersect with each other and are flush 50 with each other at the points of intersection 36. The grid has a first surface facing the rotor 38 and a second surface facing toward the arcuate ribs 40, and all of the structural elements that form the first surface have a rounded cross-sectional shape 38A proximate to the apertures 20. According to the present invention 10, the rounded 38A sides of the structural elements around the apertures or orifices minimize sharp edges in the screen which could catch material as it passes between the rotor and the grid. Additionally, the flush 50 connections between the points of intersections avoid discontinuities which could also catch material as it is passing through the apertures.

In comparison with prior art screens, examples of which is shown in FIG. 4, the screen of the present invention does not have a flat surface with sharp edges around the apertures. Instead, as explained below with regard to the embodiment shown in FIGS. 1-3, the screen has rounded bars or tubes. Alternatively, as shown in FIG. 5, the screen could have rounded sides surrounding the apertures in a grid that is formed as a curved plate. Such different designs could be formed by welding the structural elements together or by casting the grid using a molding process, and it will be appreciated that other manufacturing methods are also possible.

Figure 1C:
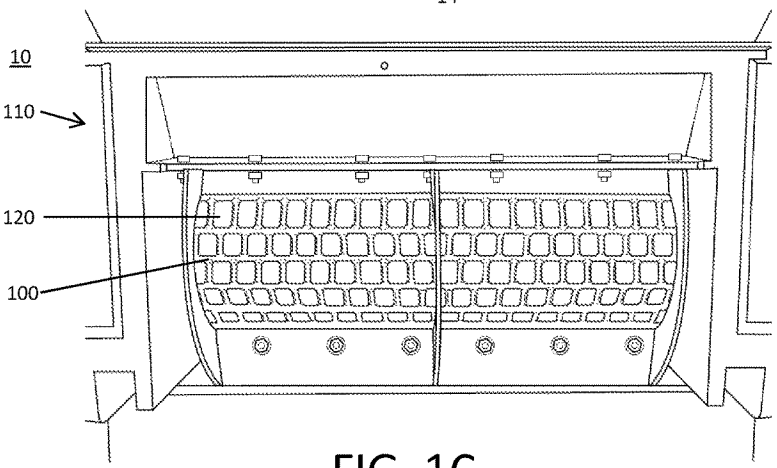
FIG. 1C is a perspective back view of the screen shown in FIGS. 1A and 1B.
Figure 1B:
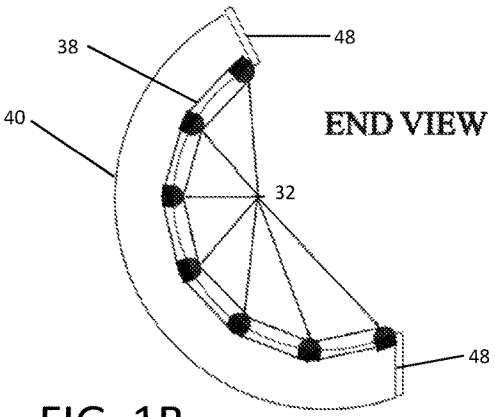
Figure 2A:
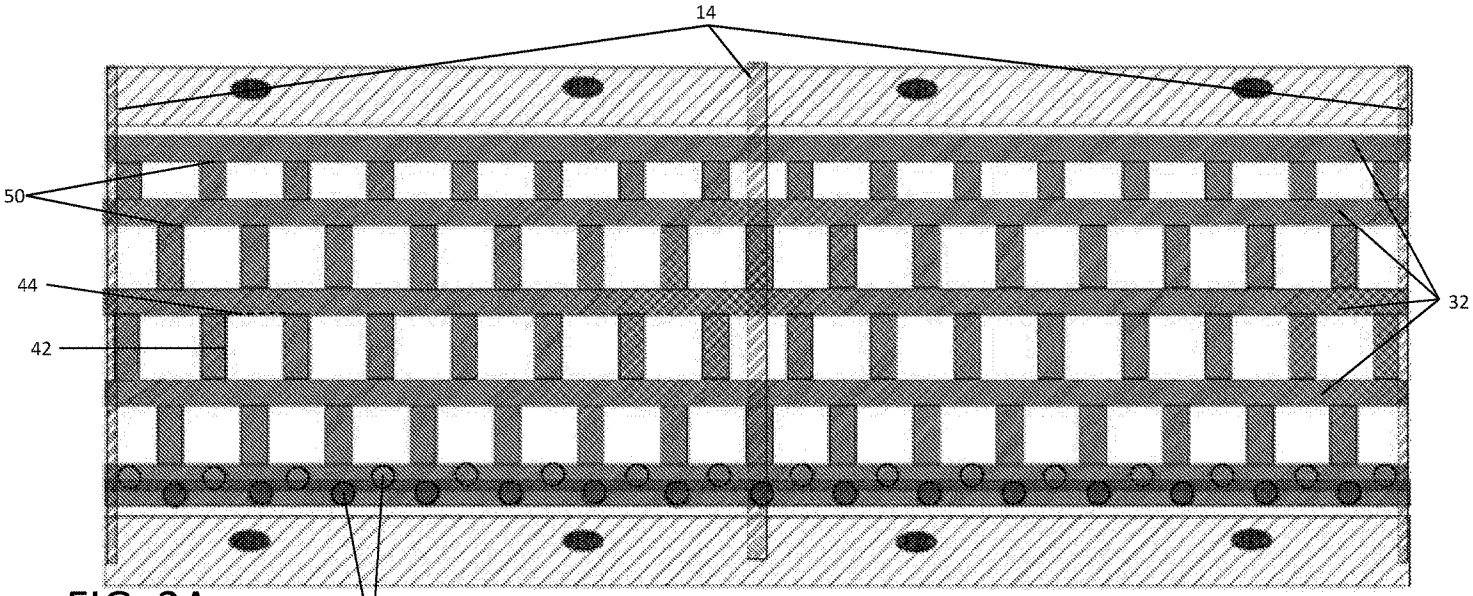
FIGS. 2A-2C are front and end views, respectively, of a screen according to another embodiment of the invention.
Figure 2C:
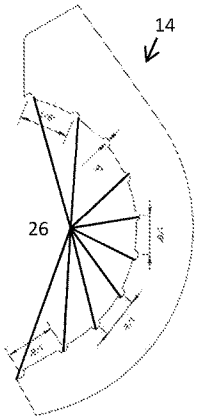
Figure 2D:
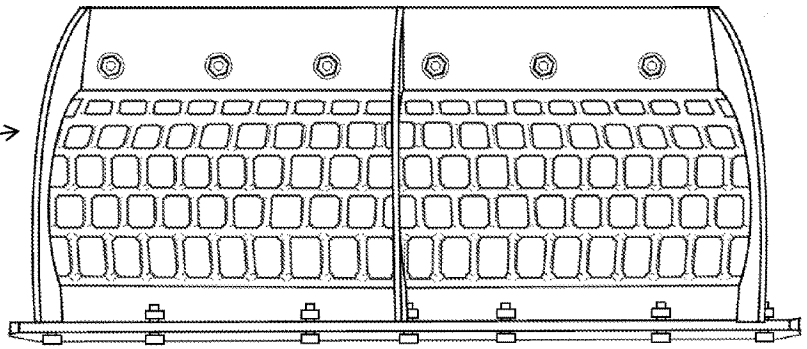
FIG. 2D is a perspective back view of the screen shown in FIGS. 2A and 2B.
Figure 2B:
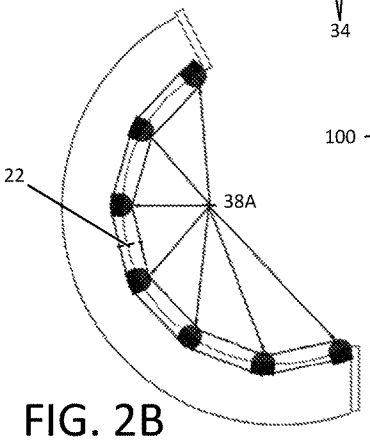

As particularly shown in FIGS. 1A, 1B and 1C, one embodiment of the grid can be formed by solid rods or thick-walled tubes 24 with a circular cross-section 24A. In this embodiment, the steel or other metal alloy mounting plate 48 is welded to the radial reinforcing ribs 14, and the mounting plate 12 is connected to the shredder machine by bolts or other fasteners. The radial reinforcing ribs 14 are preferably made from steel or another metal alloy and can be notched 26 to receive the laterally extending rods 32, and the rods are welded to the ribs in the regions with notches 26. The longitudinally extending rods 34 are welded to the laterally extending rods 32 to form the apertures in the sieve screen. The rounded surfaces of the longitudinal and lateral rods are preferably flush 50 at the intersections 36 between the rods. It will be appreciated that it is also possible to cast the intersecting rods as a unit and the ribs may also be cast with the screen.

Figure 3:
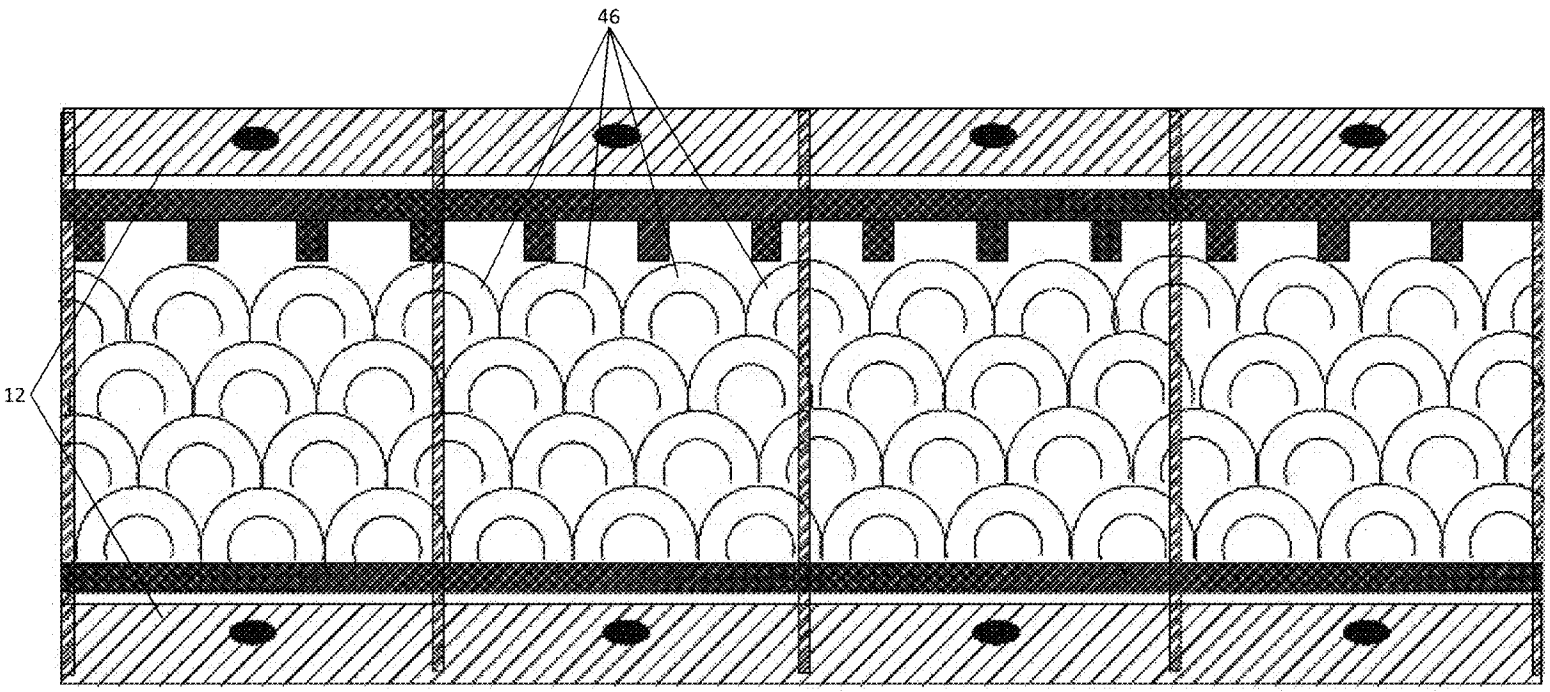
FIG. 3 is a front view of a screen with an alternative grid design.

When the screen is installed on the shredder machine, the inner facing surfaces of the rods 38 are in close proximity to the rotor. The distance between the outermost knife tip of the cutters on the rotor and the innermost surface of the screen is less than one-half inch and can be approximately 5/16" for rods having a diameter of one inch (1") with an outer rotor diameter that is a little over one foot (1'). The size of the apertures 42 and 44 in the embodiments shown in FIGS. 1 and 2 are approximately 2⅝" by 2⅞" and 2⅝" by 2¼", respectively. Generally, the space between the rods which form the aperture space is less than three (3) times the diameter of the individual rods. As explained in further detail below, the tolerances could vary, rod size could vary and the sieve size could vary depending on the material being processed and the size of the processed material that is desired. As shown in FIGS. 2 and 5, the outer side of the structural elements 40 in the grid away from the rotor may be flat or rounded while the side facing the rotor is rounded 38A. Also, alternative arrangements of structural elements can be used to form the grid, such as curved rods in the fish scale design 46 as shown in FIG. 3 a curved plate as shown in FIG. 5. In all of these embodiments, the thickness 22 of the structural elements forming the grid is sufficient to avoid significant deflection of the grid and the structural elements have curved sides surrounding the apertures. The laterally extending structural elements preferably extend parallel to each other between the ribs, and the longitudinally extending structural elements are arranged in a staggered relationship which results in a staggered arrangement of the apertures in the grid.

In the embodiments shown in FIGS. 1, 2 and 3, the curved sides of the rods have an effective radius that is the thickness of the grid. In the embodiment shown in FIG. 5, the curved sides of the plate around the apertures have an effective radius that is a little more than one half the thickness of the plate material. While a circular radius is shown in FIGS. 1 and 2, it may be possible to have other curved cross-sectional shapes or even faceted sides around the apertures, and the effective radius of such non-circular rounded shapes can be determined by standard geometric rules. For the embodiments shown in FIGS. 1 and 2, the effective diameter of the circular bars 24A and semicircular bars 24B relative to the diagonal distance of the rectangular space in the apertures through which the shredded material passes is 1:3⅞ and 1:3⅜ respectively. In all of the embodiments, the grid is preferably spaced from the rotor by a distance 28 that is less than the effective radius of the structural elements' curved sides.

Generally, the curved cross-sectional shape of the structural elements around the apertures in the grid provides a convex rounded surface which prevents the materials being processed from catching on sharp edges, particularly at the edges of apertures and in the corners of intersecting structural elements. One benefit of the screen design according to the present invention is that it does not get clogged with material so there is less wear and tear on the screen and the cutters on the rotor so there is less maintenance. Additionally, the shredder machine can operate closer to its maximum capacity without overheating the gearbox. For example, for a particular machine processing a particular material with prior art screens, the maximum production rate could be limited to 1,500 lb per hour whereas the improved screens of the present invention can permit production rates of 4,500 lb per hour or more for the same machine and the same material. Also, the structural elements forming the grid have enough strength that when there is some materials that may initially block one of the apertures, the screen does not tear apart and the shredder blades ultimately chop the material into pieces that fit through the apertures. With prior art screens that have the sharp edges around the apertures, the lower production rates would still require more frequent replacement of the screens and the cutters on the rotors would be dulled sooner as compared with screens with curved-side apertures according to the present invention. In comparison, the screen of the present invention allows the shredder to operate at a much higher production rate and does not need to be replaced as often as the known screens with sharp-edged apertures, and the cutters on the rotors are not dulled as quickly as with the prior art screens.

Accordingly, the unique rounded shape 38A of the structural elements around the apertures in the shredder screen according to the present invention yields unexpected results by increasing the throughput capability of the shredder as compared with traditional shredder screens that clog and must be run with lower production rates. Additionally, the inventive shredder screen reduces the downtime for maintenance and the associated costs of maintenance as compared with traditional shredder screens.

Figure 4A:
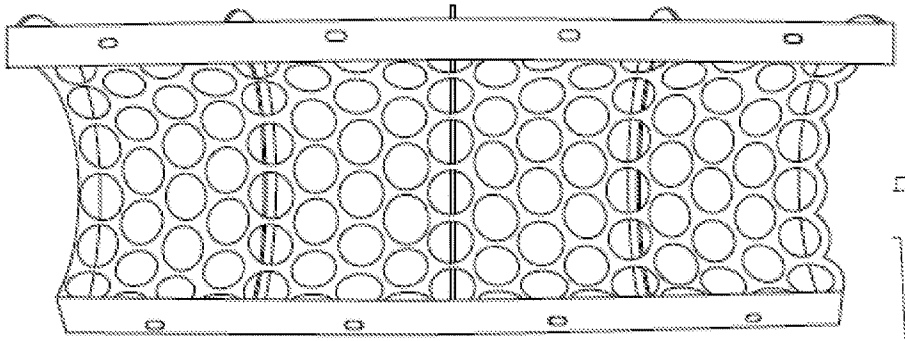
FIG. 4A (Prior Art)
FIGS. 4A-4D are views of prior art screens.
Figure 4B:
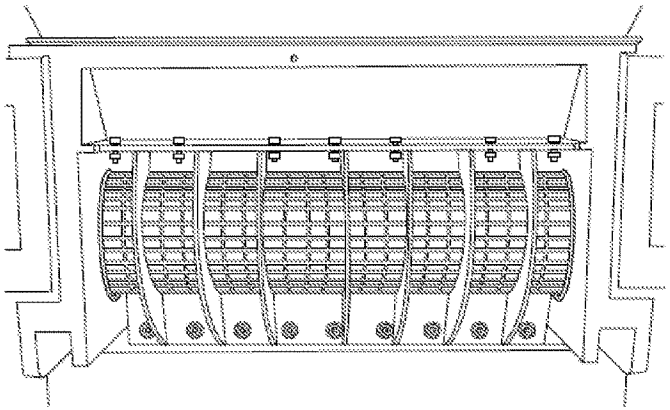
FIG. 4B (Prior Art)
Figure 4C:
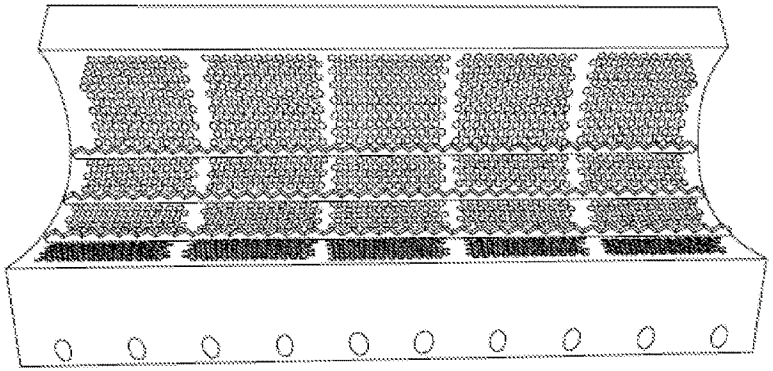
FIG. 4C (Prior Art)
Figure 4D:
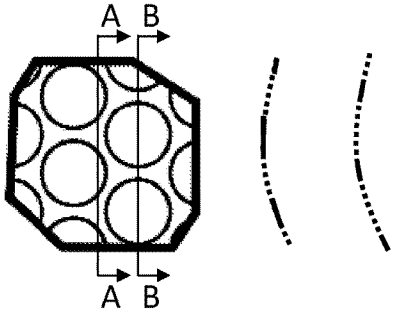
FIG. 4D (Prior Art)

As shown in FIGS. 4A, 4B and 4C, screens can have a variety of different sizes and shapes for the apertures to correspond with the material being processed and the size of the processed material that is desired. The screens shown in FIGS. 4A and 4C both have circular apertures, but the apertures in FIG. 4C are much smaller than the apertures in FIG. 4A. The apertures of the screen shown in FIG. 4B are more rectangular in shape. Regardless of the size or shape of the apertures, the apertures in these prior art screen designs have a sharp edge and a flat surface facing the rotor. For example, as shown in FIG. 4D, the cross-sectional view of circular apertures such as shown in FIGS. 4A and 4C, shows that there is no rounded side facing toward the rotor in these prior art screen designs. In comparison, for screens which have circular apertures such as in FIGS. 4A and 4C, the sides of the apertures according to the present invention would be rounded 38A with a convex curvature facing toward the rotor which results in a cross-sectional shape that is curved as shown in FIG. 5 rather than being a flat surface as shown in FIG. 4D.

The features of the present invention can be applied to many existing screen designs. For example, as shown in FIGS. 6A and 6B, features of the present invention are applied to a triple cut screen. To integrate the features of the present invention to the triple cut screen, the screen has modified longitudinally extending rods. A laterally extending slotted bed 30 is attached to the longitudinally extending rods. The bed can be connected by welding or may be cast as a part of a unitary screen. The slotted bed has knives or other cutter elements that are aligned with and match the corresponding spaces between the knives or cutters in the shredder's rotor. The spaces between the knives can vary to accommodate different types of materials. The slotted knife bed may be steel or some other metal or alloy. It will be further appreciated that the features of the present invention can be applied in the modification of other known screen designs so that they function better.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A screen for a shredding machine having a rotor, comprising:

a pair of mounting plates;

a plurality of arcuate ribs attached substantially perpendicular to and extending between said mounting plates; and an arcuate grid comprising a plurality of structural elements surrounding a plurality of apertures, wherein said arcuate grid is attached to said plurality of arcuate ribs, wherein a first set of said plurality of structural elements extend laterally between said plurality of arcuate ribs and wherein a second set of said plurality of structural elements extend longitudinally between said laterally extending structural elements, wherein said longitudinally extending structural elements are connected to said laterally extending structural elements in a flush relationship at a plurality of intersections between said longitudinally extending structural elements and said laterally extending structural elements, wherein said plurality of structural elements have a first surface facing the rotor and a second surface facing toward said plurality of arcuate ribs, and wherein said first surface has a rounded cross-sectional shape proximate to said plurality of apertures.

2. The screen of claim 1, wherein said arcuate grid has a thickness and said plurality of structural elements have curved sides surrounding said plurality of apertures, wherein said curved sides have an effective radius of at least one half of said thickness.

3. The screen of claim 2, wherein said arcuate grid is comprised of a plurality of bars with at least one of a circular cross-section or semicircular cross-section.

4. The screen of claim 3, wherein a first set of said plurality of bars extend between said arcuate ribs and a second set of said plurality of bars are in a staggered relationship between said first set of said plurality of bars.

5. The screen of claim 3, wherein said plurality of arcuate ribs are comprised of a plurality of longitudinally spaced notches, wherein said plurality of bars are fastened to and extend between said plurality of arcuate ribs at said plurality of longitudinally spaced notches.

6. The screen of claim 2, wherein said arcuate grid is spaced from the rotor by a distance and wherein said effective radius of said curved sides is greater than said distance.

7. The screen of claim 1, wherein said arcuate grid is further comprised of a laterally extending slotted knife bed.

8. The screen of claim 1, wherein each one of said plurality of apertures has a lateral distance and a longitudinal distance between said plurality of structural elements that is less than three times a diameter of any one of said plurality of structural elements.

9. The screen of claim 1, wherein an effective diameter of any one of said plurality of structural elements relative to an average diagonal distance of said plurality of apertures between said plurality of structural elements has a ratio of less than 1:4.

10. A screen for a shredding machine having a rotor, comprising:

a pair of mounting plates;

a plurality of arcuate ribs attached substantially perpendicular to and extending between said mounting plates; and an arcuate grid comprising a plurality of structural elements, wherein said plurality of structural elements have a circular cross-sectional shape and surround a plurality of apertures, wherein said arcuate grid is attached to said plurality of arcuate ribs, wherein a first set of said plurality of structural elements extend laterally between said plurality of arcuate ribs and wherein a second set of said plurality of structural elements extend longitudinally between said laterally extending structural elements, wherein said longitudinally extending structural elements are connected to said laterally extending structural elements in a flush relationship at a plurality of intersections between said longitudinally extending structural elements and said laterally extending structural elements, wherein said plurality of structural elements have a first rounded surface facing the rotor and a second rounded surface facing toward said plurality of arcuate ribs.

11. The screen of claim 10, wherein said arcuate grid is further comprised of a laterally extending slotted knife bed.

12. The screen of claim 10, wherein said first set of plurality of structural elements are substantially parallel to each other between said plurality of arcuate ribs, and wherein said second set of plurality of structural elements are in a staggered relationship between said first set of plurality of structural elements.

13. The screen of claim 10 wherein each one of said plurality of apertures has a lateral distance and a longitudinal distance between said plurality of structural elements that is less than three times a diameter of any one of said plurality of structural elements.

14. The screen of claim 10, wherein an effective diameter of any one of said plurality of structural elements relative to an average diagonal distance of said plurality of apertures between said plurality of structural elements has a ratio of less than 1:4.

15. The screen of claim 10, wherein said plurality of arcuate ribs are comprised of a plurality of longitudinally spaced notches, wherein said plurality of bars are fastened to and extend between said plurality of arcuate ribs at said plurality of longitudinally spaced notches.

16. A screen for a shredding machine having a rotor, comprising:

a pair of mounting plates;

a plurality of arcuate ribs attached substantially perpendicular to and extending between said mounting plates, wherein said plurality of arcuate ribs have a plurality of longitudinally spaced notches; and an arcuate grid comprising a plurality of bars, wherein said plurality of bars have a circular cross-sectional shape and surround a plurality of apertures, wherein said arcuate grid is attached to said plurality of arcuate ribs, wherein a first set of said plurality of bars are attached to said plurality of arcuate ribs at said plurality of longitudinally spaced notches and extend laterally between said plurality of arcuate ribs and wherein a second set of said plurality of bars extend longitudinally between said laterally extending structural elements, wherein said longitudinally extending bars are connected to said laterally extending bars in a flush relationship at a plurality of intersections between said longitudinally extending bars and said laterally extending bars, wherein said plurality of bars have a first rounded surface facing the rotor and a second rounded surface facing toward said plurality of arcuate ribs.

17. The screen of claim 16 wherein each one of said plurality of apertures has a lateral distance and a longitudinal distance between said plurality of bars that is less than three times a diameter of any one of said plurality of bars.

18. The screen of claim 16, wherein an effective diameter of any one of said plurality of bars relative to an average diagonal distance of said plurality of apertures between said plurality of bars has a ratio of less than 1:4.

19. The screen of claim 16, wherein said first set of said plurality of bars are substantially parallel to each other between said plurality of arcuate ribs, and wherein said second set of said plurality of bars are in a staggered relationship between said first set of said plurality of bars.

20. The screen of claim 16, wherein said arcuate grid is further comprised of a laterally extending slotted knife bed.

* * * * *